US006969146B2

(12) United States Patent
Brookfield et al.

(10) Patent No.: US 6,969,146 B2
(45) Date of Patent: Nov. 29, 2005

(54) DROP GENERATING APPARATUS

(75) Inventors: John M. Brookfield, Woodburn, OR (US); Rodney B. Hill, Silverton, OR (US); James D. Padgett, Lake Oswego, OR (US); John S. Moore, Beaverton, OR (US); Eric Segerstrom, Austin, TX (US); Brian E. Sonnichsen, Portland, OR (US); Christine M. Greiser, West Linn, OR (US)

(73) Assignee: Xerox Corporation, Stamford, CT (US)

( * ) Notice: Subject to any disclaimer, the term of this patent is extended or adjusted under 35 U.S.C. 154(b) by 159 days.

(21) Appl. No.: 10/755,725

(22) Filed: Jan. 10, 2004

(65) Prior Publication Data

US 2005/0151786 A1 Jul. 14, 2005

(51) Int. Cl.[7] ..... B41J 2/145
(52) U.S. Cl. ..... 347/40; 347/43; 347/68
(58) Field of Search ..... 347/12, 40, 43, 347/15, 68, 70, 71, 41

(56) References Cited

U.S. PATENT DOCUMENTS

| | | | | |
|---|---|---|---|---|
| 5,038,153 A | | 8/1991 | Liechti et al. | |
| 5,278,584 A | | 1/1994 | Keefe et al. | 346/140 |
| 5,469,199 A | | 11/1995 | Allen et al. | 347/42 |
| 5,638,101 A | | 6/1997 | Keefe et al. | 347/65 |
| 5,907,338 A | | 5/1999 | Burr et al. | 347/43 |
| 5,949,452 A | | 9/1999 | Jones | 347/41 |
| 5,984,455 A | | 11/1999 | Anderson | 347/47 |
| 6,106,101 A | * | 8/2000 | Suzuki | 347/40 |
| 6,113,231 A | | 9/2000 | Burr et al. | 347/103 |
| 6,123,410 A | | 9/2000 | Beerling et al. | 347/42 |
| 6,435,653 B1 | | 8/2002 | Boyd et al. | 347/42 |
| 6,502,920 B1 | | 1/2003 | Anderson et al. | |
| 6,637,860 B1 | * | 10/2003 | Madeley | 347/42 |
| 6,808,254 B2 | * | 10/2004 | Sakaida et al. | 347/71 |

FOREIGN PATENT DOCUMENTS

EP 0726151 A2 8/1996

OTHER PUBLICATIONS

Examiner F. Callan, European Search Report for EP 06250050, Apr. 21, 2005, Munich.

* cited by examiner

*Primary Examiner*—Lamson Nguyen
(74) *Attorney, Agent, or Firm*—Manuel Quiogue

(57) ABSTRACT

A drop emitting device including a first linear array of columnar arrays of first nozzle pairs and a second linear array of columnar arrays of second nozzle pairs, wherein the first linear array and the second linear array extend along an X-axis, and wherein the second linear array is adjacent the first linear array such that each first nozzle pair has an associated second nozzle pair displaced therefrom along a Y-axis that is orthogonal to the X-axis. The columnar arrays of first nozzle pairs and the columnar arrays of second nozzle pairs extend obliquely to the X-axis.

19 Claims, 13 Drawing Sheets

FIG. 5A
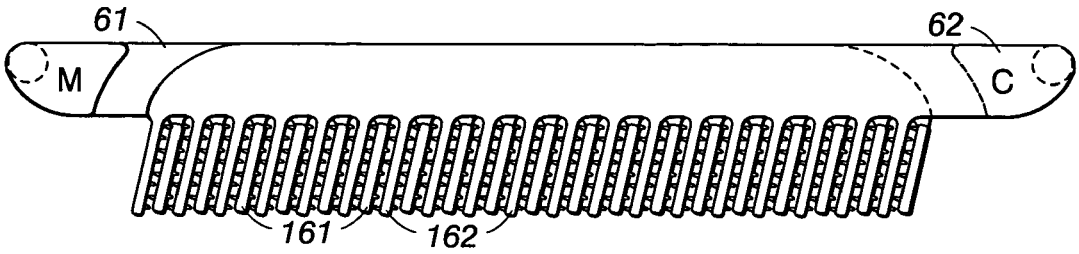
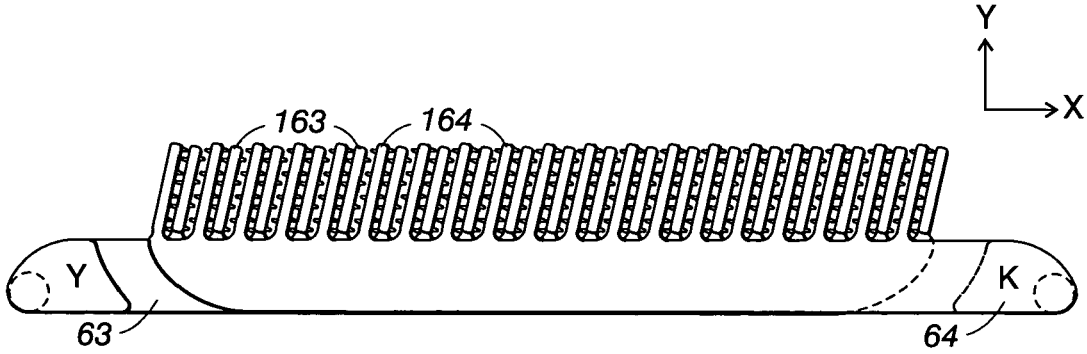
FIG. 5B

FIG. 8
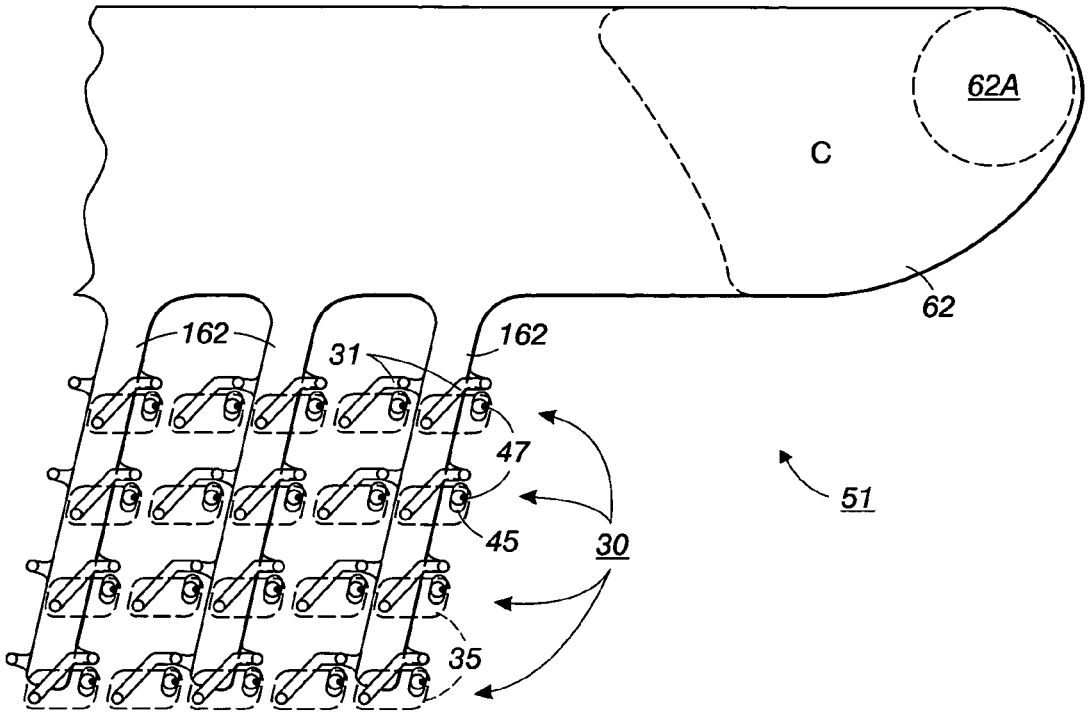
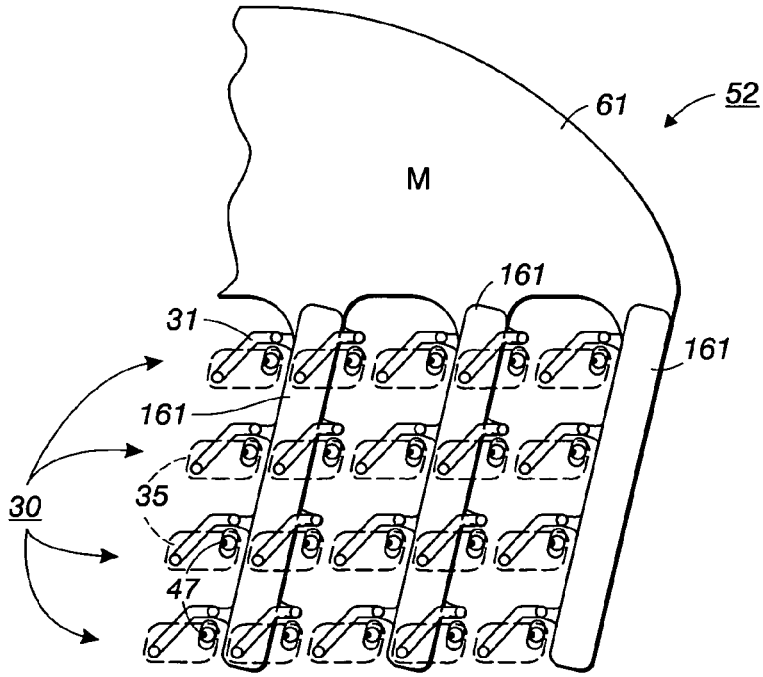
FIG. 9

DROP GENERATING APPARATUS

BACKGROUND OF THE DISCLOSURE

The disclosure relates generally to drop emitting apparatus including for example drop jetting devices.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

BRIEF DESCRIPTION OF DRAWINGS

FIG. 5A schematically illustrates the relative positioning of the manifold structures of FIGS. 4A and 4B.

FIG. 5B schematically illustrates the relative positioning of the manifold structures of FIGS. 4C and 4D.

FIG. 8 schematically illustrates an arrangement of ink drop generators fluidically coupled to the manifold structure of FIG. 4B.

FIG. 9 schematically illustrates an arrangement of ink drop generators fluidically coupled to the manifold structure of FIG. 4C.

DETAILED DESCRIPTION OF THE DISCLOSURE

Figure 1:
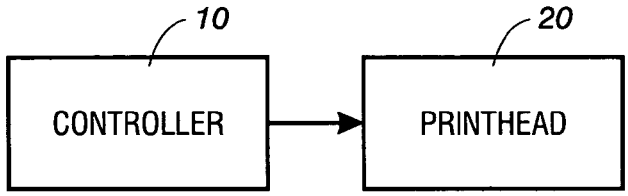
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
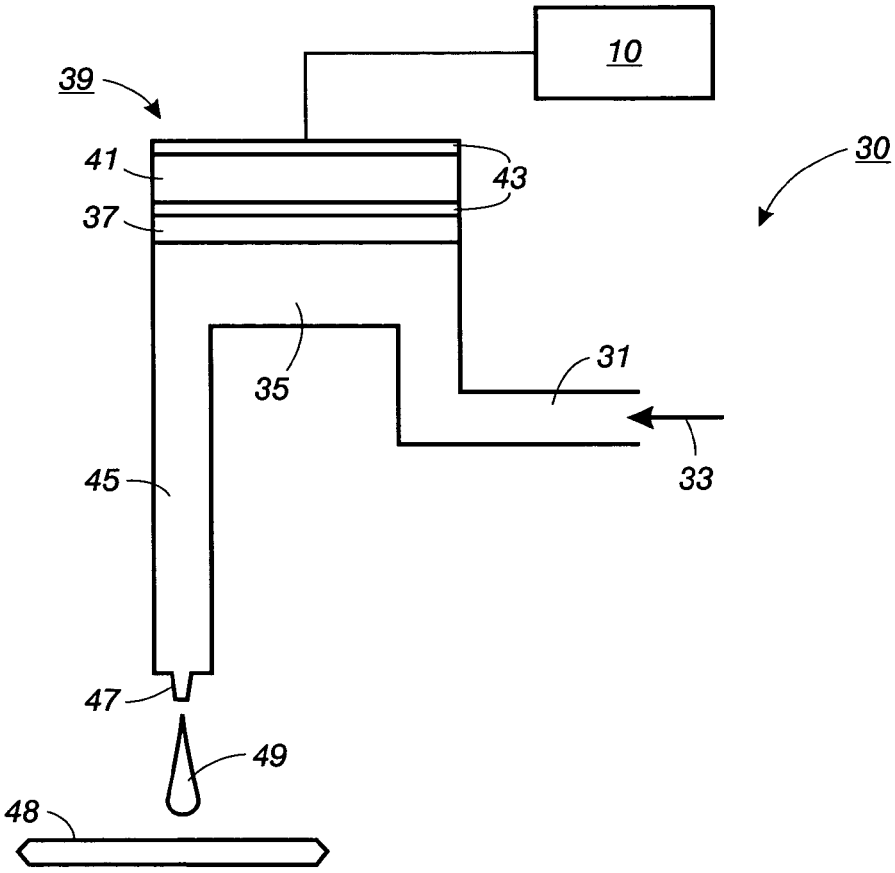
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that, in embodiments disclosed herein, receives ink 33 from an ink containing finger manifold structure 161, 162, 163, 164 (FIGS. 4A–4D, 5A, 5B, 6–10). The ink 33 flows into an ink pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 through an outlet channel 45 to a drop forming nozzle or orifice 47, from which an ink drop 49 is emitted toward a receiver medium 48 that can be a transfer surface, for example.

The ink 33 can be melted or phase changed solid ink, and the electromechanical transducer 39 can be a piezoelectric transducer that is operated in a bending mode, for example.

Figure 3:
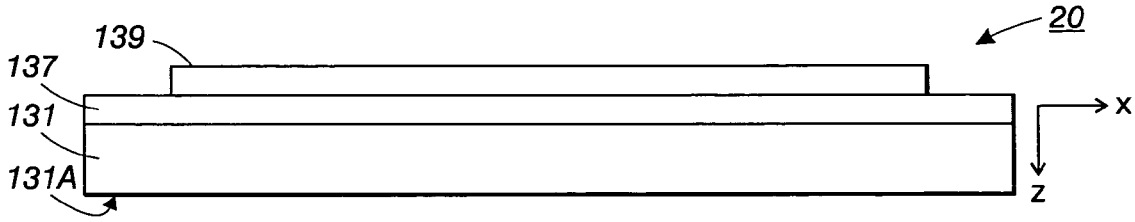
FIG. 3 is a schematic elevational view of an embodiment of an ink jet printhead assembly.
Figure 4A:
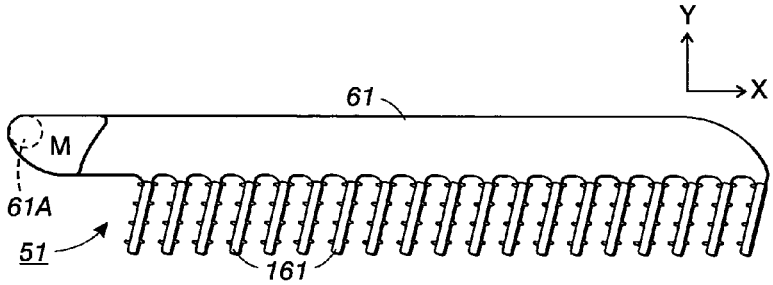
FIGS. 4A, 4B, 4C, 4D are schematic diagrams of embodiments of manifold structures that can be employed in the ink jet printhead of FIG. 3.
Figure 4B:
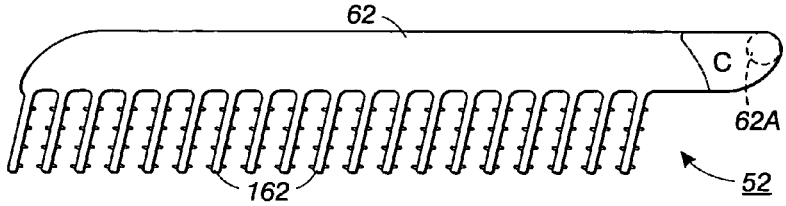
Figure 4C:
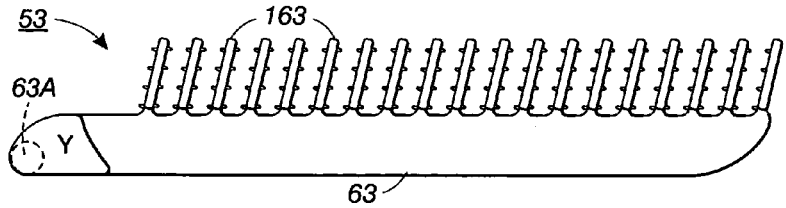
Figure 4D:
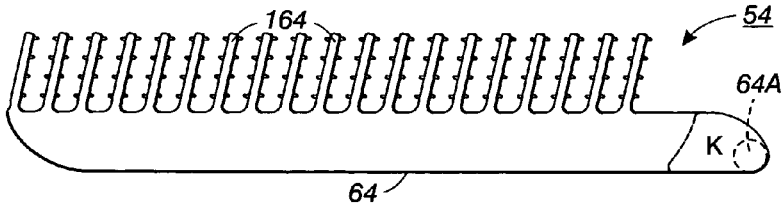

FIG. 3 is a schematic elevational view of an embodiment of an ink jet printhead assembly 20 that can implement a plurality of drop generators 30 (FIG. 2) as an array of drop generators. The ink jet printhead assembly includes a fluid channel layer or substructure 131, a diaphragm layer 137 attached to the fluid channel layer 131, and transducer layer 139 attached to the diaphragm layer 137. The fluid channel layer 131 implements the fluid channels and chambers of the drop generators 30, while the diaphragm layer 137 implements the diaphragms 37 of the drop generators. The transducer layer 139 implements the piezoelectric transducers 39 of the drop generators 30. The nozzles of the drop generators 30 are disposed on an outside surface 131A of the fluid channel layer 131 that is opposite the diaphragm layer 137, for example.

By way of illustrative example, the diaphragm layer 137 comprises a metal plate or sheet such as stainless steel that is attached or bonded to the fluid channel layer 131. Also by way of illustrative example, the fluid channel layer 131 can comprise a laminar stack of plates or sheets, such as stainless steel.

For reference, an XYZ coordinate system can be associated with the printhead assembly 20, wherein the XY plane is parallel to the outside surface 131A of the printhead that contains the ink drop emitting nozzles 47, and wherein the Y-axis is orthogonal to the plane of FIG. 3. The layering of the fluid channel layer 131, the diaphragm layer 137, and the transducer layer 139 is along the Z-axis. For further reference, the outside surface 131A of the fluid channel layer 131 that contains the drop emitting nozzles 47 can be considered the front surface of the printhead, while the transducer layer 139 can be considered back of the printhead. Also, the outside surface 131A that contains the drop emitting nozzles 47 can be called the nozzle side of the printhead. By way of illustrative example, the receiver surface can be moved along the Y-axis relative to the printhead assembly.

FIGS. 6–10 schematically illustrate embodiments of the fluid channel structure of the fluid channel layer 131 of the printhead 20 of FIG. 3. The fluid channel structure can be implemented by openings formed in various layers of a laminar structure that comprises the fluid channel layer 131. For ease of illustration, the fluid conveying volumes of the fluid channel structure are shown without the walls that define such volumes. Also, to facilitate understanding, the various portions of the fluid channel structure will be illustrated in different figures.

Figure 6:
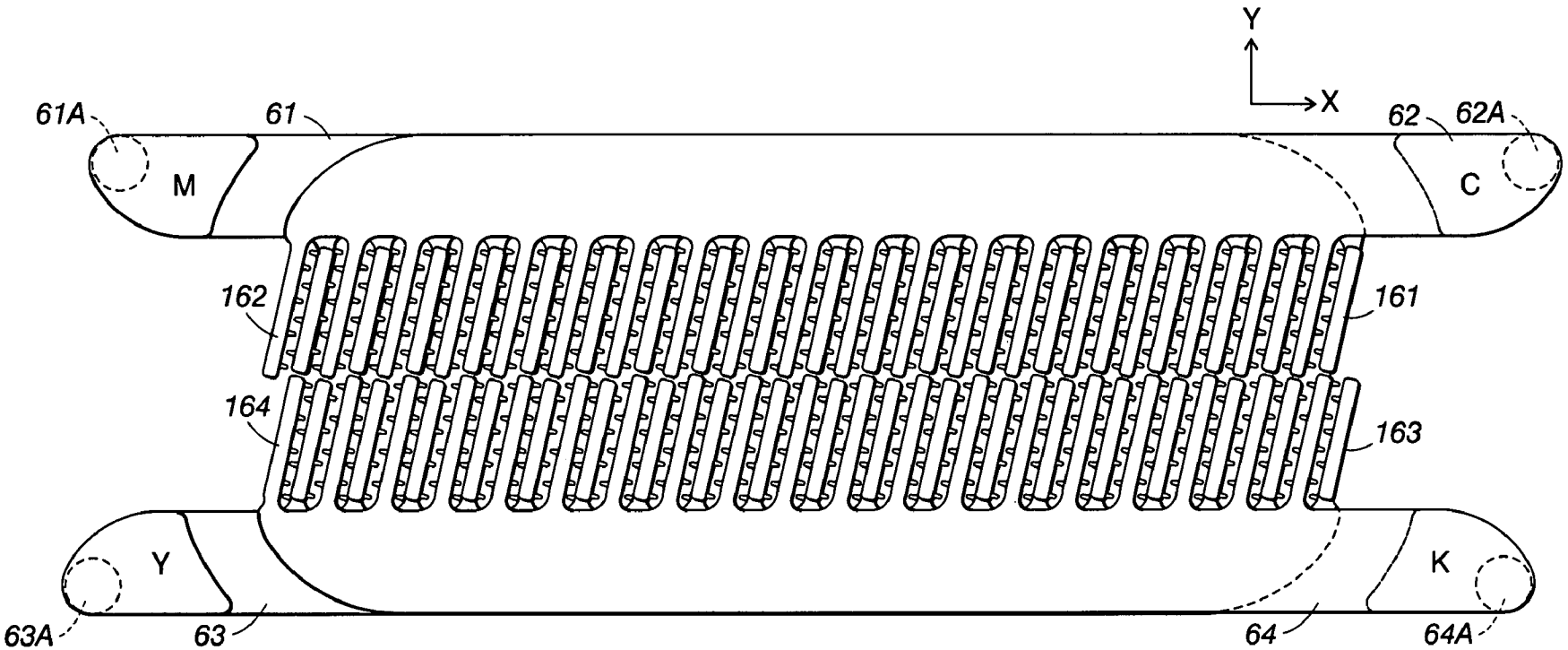
FIG. 6 is a schematic diagram of a manifold network formed of the manifold structures of FIGS. 4A, 4B, 4C, 4D.

FIG. 6 is an embodiment of a manifold network that is formed of a plurality of first through fourth manifold structures 51, 52, 53, 54, embodiments of which are individually illustrated in FIGS. 4A–4D for ease of viewing. FIG. 5A illustrates the relative positioning of the first manifold structure 51 and the second manifold structure 52, while FIG. 5B illustrates the relative positioning of the third manifold structure 53 and the fourth manifold structure 54.

The first manifold structure 51 includes a first ink distributing primary manifold 61, and the second manifold structure 52 includes a second ink distributing primary manifold 62. The first and second primary manifolds 61, 62 can extend longitudinally along the X-axis, and can be generally parallel. The first and second primary manifolds 61, 62 can also be side by side or overlapping along the Z-axis. The first and second primary manifolds 61, 62 can be adjacent a longitudinal edge of the printhead fluid channel layer 131, and can receive ink through respective input ports 61A, 62A.

A plurality of first intermediate or finger manifolds 161 are fluidically coupled to the first primary manifold 61 and extend generally transversely from the first primary manifold toward a middle portion of the fluid channel layer 131. By way of illustrative example, the first finger manifolds can be substantially parallel to each other (i.e, substantially mutually parallel), and the longitudinal extents of the first finger manifolds 161 can be slanted or oblique to the Y-axis and to the X-axis.

A plurality of second intermediate or finger manifolds 162 are fluidically coupled to the second primary manifold 62 and extend generally transversely from the second primary manifold 62 toward a middle portion of the fluid channel layer 131. As illustrated more particularly in FIG. 5A, the second finger manifolds 162 are interleaved with the first finger manifolds 162. By way of illustrative example, the second finger manifolds 162 can be substantially parallel to each other (i.e., substantially mutually parallel), and the longitudinal extents of the second finger manifolds 162 can be slanted or oblique to the Y-axis and to the X-axis.

The first finger manifolds 161 and the second finger manifolds 162 can be substantially mutually parallel, and can thus be side by side along the longitudinal extents of the first and second primary manifolds 61, 62.

In this manner, the first finger manifolds 161 comprise a first linear array of generally laterally extending slanted finger manifolds, and the second finger manifolds 162 comprise a second linear array of generally laterally extending slanted finger manifolds. These first and second linear arrays of slanted finger manifolds extend along the X-axis, and the interleaved first and second finger manifolds together form a composite linear array of generally laterally extending slanted finger manifolds that extends along the X-axis. The first finger manifolds 161 can be considered a first linear sub-array of the composite linear array, and the second finger manifolds 162 can be considered a second linear sub-array of the composite linear array.

The third manifold structure 53 includes a third ink distributing primary manifold 63, and the fourth manifold structure 54 includes a fourth ink distributing primary manifold 64. The third and fourth primary manifolds 63, 64 can extend longitudinally along the X-axis. The third and fourth primary manifolds 63, 64 can further be generally parallel to the first and second primary manifolds 61, 62. The third and fourth primary manifolds 63, 64 can also be side by side or overlapping along the Z-axis. The third and fourth primary manifolds can be located for example adjacent an edge of the printhead fluid channel layer 131 that is opposite the edge at which the first and second primary manifolds 61, 62 are adjacently located, and can receive ink through respective input ports 63A, 64A.

A plurality of third intermediate or finger manifolds 163 are fluidically coupled to the third primary manifold 63 and extend generally transversely from the third primary manifold 63 toward a middle portion of the fluid channel layer 131. By way of illustrative example, the third finger manifolds can be substantially parallel to each other (i.e., substantially mutually parallel), and the longitudinal extents of the third finger manifolds 163 can be slanted or oblique to the Y-axis and to the X-axis. The third finger manifolds 163 can further be substantially parallel to the first finger manifolds 61 or the second finger manifolds 62.

A plurality of fourth intermediate or finger manifolds 164 are fluidically coupled to the fourth primary manifold 64 and extend generally transversely from the fourth primary manifold 64 toward a middle portion of the fluid channel layer 131. As illustrated more particularly in FIG. 5B, the fourth finger manifolds 164 are interleaved with the third finger manifolds 163. By way of illustrative example, the fourth finger manifolds 164 can be substantially parallel to each other (i.e, substantially mutually parallel), and the longitudinal extents of the fourth finger manifolds 164 can be slanted or oblique to the Y-axis and to the X-axis. The fourth finger manifolds 164 can further be substantially parallel to the first finger manifolds 61 or the second finger manifolds 62.

The third and fourth finger manifolds 163, 164 can be substantially mutually parallel, and thus can be side by side along the longitudinal extents of the third and fourth primary manifolds 63, 64.

In this manner, the third finger manifolds 163 comprise a third linear array of generally laterally extending slanted finger manifolds, and the fourth finger manifolds 164 comprise a fourth linear array of generally laterally extending slanted finger manifolds. The third and fourth linear arrays extend along the X-axis, and the interleaved third and fourth finger manifolds together form a composite linear array of generally laterally extending slanted finger manifolds that extends along the X-axis. The third finger manifolds 163 can be considered a first linear sub-array of the composite linear array, and the fourth finger manifolds 164 can be considered a second linear sub-array of the composite linear array.

By way of illustrative example, the first, second, third and fourth finger manifolds 161, 162, 163, 164 can be substantially mutually parallel. Also, the first finger manifolds 161 can be generally aligned with the fourth finger manifolds 164, while the second finger manifolds 162 can be generally aligned with the third finger manifolds 163.

The first and second primary manifolds 61, 62 can receive inks of different colors or of the same color. By way of illustrative example, the first and second primary manifolds 61, 62 can receive magenta (M) ink and cyan (C) ink respectively. The third and fourth primary manifolds 63, 64 can receive inks of different colors or of the same color. By way of illustrative example, the third and fourth primary manifolds 63, 64 can receive yellow (Y) ink and black (K) ink respectively. For ease of reference, some of the elements in the drawings include the designations M, C, Y, or K for the illustrative example wherein the first through fourth primary manifolds 61–64 respectively distribute magenta, cyan, yellow and black inks.

As another example, the first and second primary manifolds 61, 62 can receive ink of a first color, while the third and fourth primary manifolds 63, 64 receive ink of a second color. As yet another example, all of the primary manifolds 61–64 receive ink of the same color. As still another example, the first and second primary manifolds 61, 62 respectively receive inks of a first color and a second color, while the third and fourth primary manifolds 63, 64 receive ink of a third color. Other combinations can also be employed.

Figure 7:
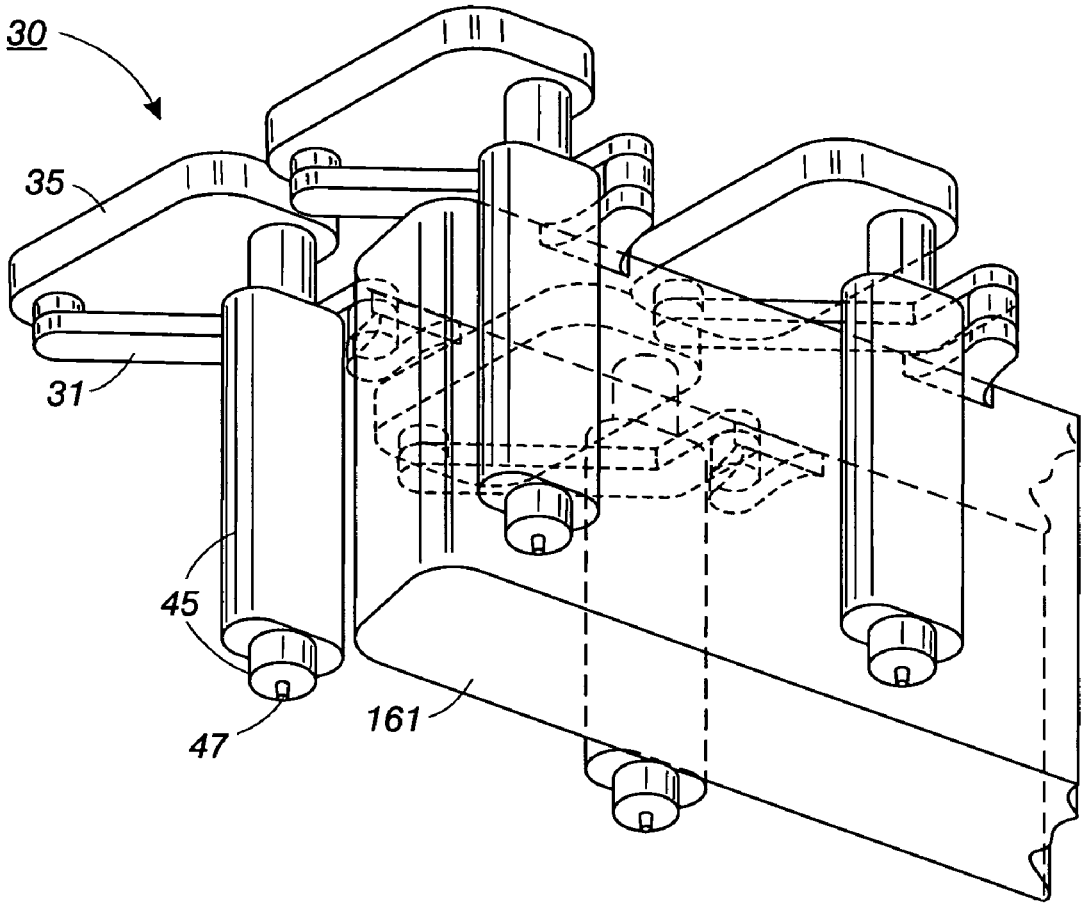
FIG. 7 is a schematic isometric view generally illustrating a plurality of ink drop generators that are fluidically coupled to a finger manifold.

As generally illustrated in FIG. 7 for a representative finger manifold 161, a plurality of ink drop generators 30 can be fluidically coupled to each of the finger manifolds 161, 162, 163, 164. The ink drop generators 30 can be located on either side of a finger manifold. Each ink drop generator is located such that its outlet channel 45 is adjacent the associated finger manifold to which it is coupled and extends through a gap between the associated finger manifold and an adjacent finger manifold. The ink pressure chambers 35 of the ink drop generators 30 are located behind or above the associated finger manifolds, while the nozzles 47 are located in front of or below the associated finger manifolds.

Figure 10:
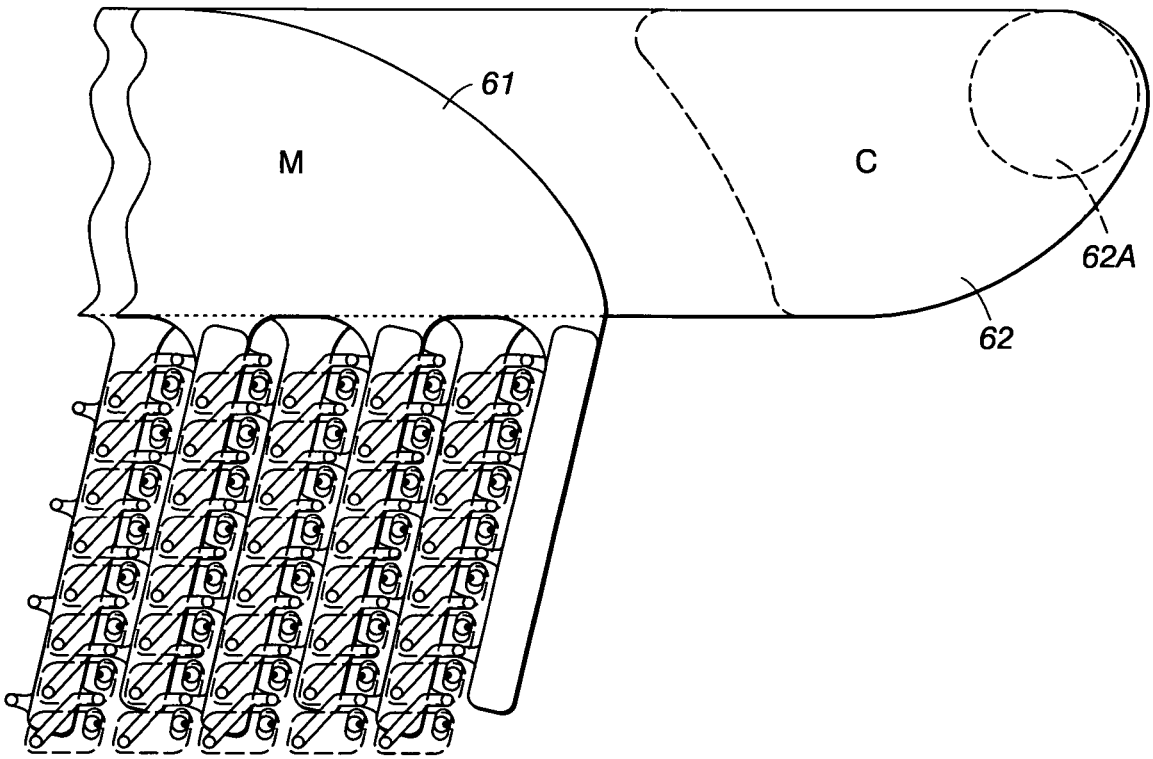
FIG. 10 schematically illustrates an arrangement of ink drop generators fluidically coupled to the manifold structures of FIGS. 4B and 4C, wherein such manifold structures are positioned side by side.

By way of illustrative example, as shown schematically in FIGS. 8–10 for adjacent fragmentary portions of the manifold structures 51 and 52, the ink drop generators 30 can be arranged in slanted linear columns of drop generators having outlet channels extending between adjacent finger manifolds 161/162 and 163/164. The ink drop generators 30 of each column can be alternatingly fluidically connected to the associated adjacent finger manifolds. In this manner, the ink drop generators associated with an adjacent pair of finger manifolds can be alternatingly fluidically coupled to different primary manifolds.

Figure 11:
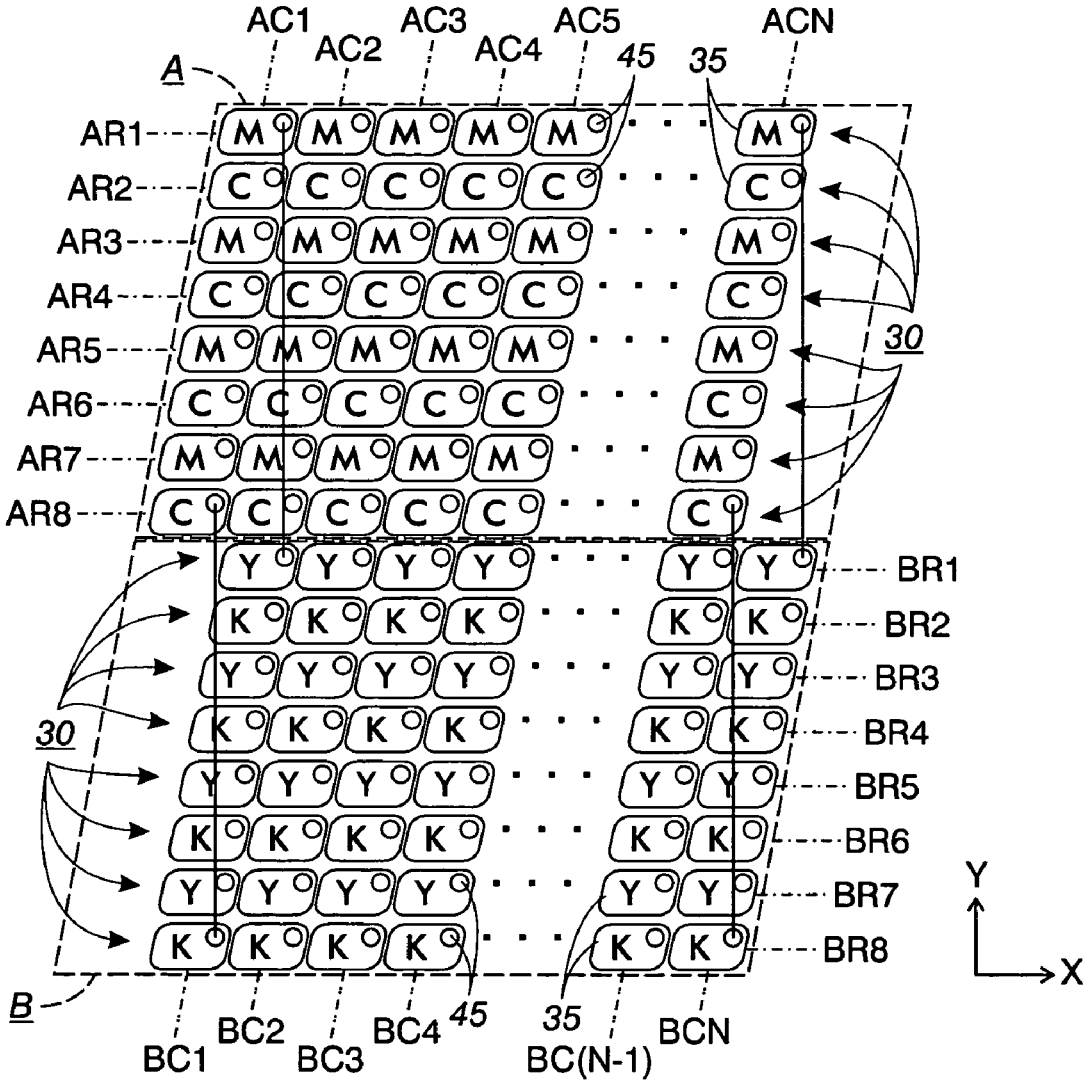
FIG. 11 schematically illustrates an arrangement of ink drop generators of the printhead of FIG. 3.

FIG. 11 is a schematic view of an embodiment of an arrangement of the drop generators 30 of the printhead 20 as viewed from the nozzle side 131A of the printhead, for the illustrative example wherein the first through fourth primary manifolds 61, 62, 63, 64 respectively provide magenta (M), cyan (C), yellow (Y) and black (K) primary colors. For ease of viewing, only the ink chambers 35 and the outlet channels 45 are shown in FIG. 11. Although not shown, the finger manifolds would extend between the columns of outlet channels 45 and also along the outboard side of the outboard columns of outlet channels.

In the embodiment shown in FIG. 11, the drop generators are grouped or arranged in two arrays A, B of ink drop generators 30. Each of the ink drop generators 30 of the array A is fluidically coupled to one of the first finger manifolds 161 or one of the second finger manifolds 162, and thus is fluidically coupled to the first primary manifold 61 or to the second primary manifold 62. Each of the ink drop generators 30 of the array B is fluidically coupled to one of the third finger manifolds 163 or one of the fourth finger manifolds 164, and thus is fluidically coupled to the third primary manifold 63 or to the fourth primary manifold 64. For ease of reference, the drop generators are identified with the letters M, C, Y or K to indicate their respective fluidic connections to the finger manifolds 161, 162, 163, or 164 for the illustrative example wherein the primary manifolds 61, 62, 63, 64 provide magenta (M), cyan (C), yellow (Y) and black (K) primary colors.

The ink drop generators 30 of the array A are more particularly arranged in a linear array of slanted, side by side columnar arrays AC1–ACN. The linear array extends along the X-axis, and the slanted columnar arrays can be substantially mutually parallel and slanted or oblique relative to the X-axis as well as the Y-axis. Each columnar array includes the same number of ink drop generators, and the columnar arrays can be substantially aligned along the Y-axis such that the ink drop generators 30 form rows AR1–AR8 that can be substantially mutually parallel and generally parallel to the X-axis. The drop generators 30 in each row can be co-linear or offset along an axis of the row, while the drop generators in each columnar array can be co-linear or offset along an axis of the columnar array, for example. Eight rows are shown as an illustrative example and it should be appreciated that the number of rows can be appropriately selected. The ink drop generators 30 of the array A can conveniently be referenced by their column and row location (e.g., AC1/AR1, AC1/AR2, etc.).

By way of illustrative example, in each column, the ink drop generators of the odd numbered rows AR1, AR3, AR5, AR7 can be fluidically connected to an associated first finger manifold 161, while the ink drop generators of the even numbered rows AR2, AR4, AR6, AR8 can be connected to an associated second finger manifold 162 that is adjacent to the associated first finger manifold 161. In other words, the ink drop generators of each column AC1–ACN are alternatingly fluidically coupled, row by row, to one of an associated pair of finger manifolds, wherein the associated pair of finger manifolds comprises a first finger manifold 161 and a second finger manifold 162 that is adjacent to the first finger manifold 161. In this manner, the ink drop generators of the odd numbered rows AR1, AR3, AR5, AR7 can be fluidically coupled to the first primary manifold 61, while ink drop generators of the even numbered rows AR2, AR4, AR6, AR8 can be fluidically coupled to the second primary manifold 62. Thus, the rows AR1–AR8 of drop generators can be alternatingly fluidically coupled, row by row, to the first primary manifold 61 and the second primary manifold 62.

In this manner, the array A can also be considered as a plurality of offset rows AR1–AR8 of ink drop generators, wherein each row of drop generators is fluidically coupled to a common primary manifold.

Each slanted column AC1–ACN of drop generators can also be considered as being comprised of interleaved sub-columns, wherein one sub-column includes drop generators in the odd numbered rows AR1, AR3, AR5, AR7 while another sub-column includes drop generators in the even numbered rows AR2, AR4, AR6, AR8. In this manner, the ink drop generators of one sub-column are fluidically coupled to the associated first finger manifold 161 while the ink drop generators of the other sub-column are fluidically coupled to the associated second finger manifold 162. For the illustrative example wherein the first finger manifolds 161 provide magenta ink and wherein the second finger manifolds 162 provide cyan ink, each slanted column AC1–ACN is formed of a magenta (M) sub-column interleaved with a cyan (C) sub-column.

The ink drop generators 30 of the array B are more particularly arranged in a linear array of slanted, side by side columnar arrays BC1–BCN. The linear array extends along the X-axis, and the slanted columnar arrays can be substantially mutually parallel and slanted or oblique relative to the X-axis as well as the Y-axis. Each columnar array includes the same number of ink drop generators, and the columnar arrays can be substantially aligned along the Y-axis such that the ink drop generators 30 form rows BR1–BR8 that can be substantially mutually parallel and generally parallel to the X-axis. The drop generators in each row can be co-linear or offset along an axis of the row, while the drop generators in each column can be co-linear, or offset or staggered along an axis of the column, for example. Eight rows are shown as an illustrative example and it should be appreciated that the number of rows can be appropriately selected. The ink drop generators of the array B can conveniently be referenced by their column and row location (e.g., BC1/BR1, BC1/BR2, etc.).

By way of illustrative example, in each columnar array, the ink drop generators of the odd numbered rows BR1, BR3, BR5, BR7 are fluidically connected to an associated third finger manifold 163, while the ink drop generators of the even numbered rows BR2, BR4, BR6, BR8 are fluidically connected to an associated fourth finger manifold 164 that is adjacent to the associated third finger manifold 163. In other words, the ink drop generators of each column BC1–BCN can be alternatingly fluidically coupled, row by row, to one of an associated pair of finger manifolds, wherein the associated pair of finger manifolds comprises a third finger manifold 163 and a fourth finger manifold 164 that is adjacent to the third finger manifold 163. In this manner, the ink drop generators of the odd numbered rows BR1, BR3, BR5, BR7 can be fluidically coupled to the third primary manifold 63, while ink drop generators of the even numbered rows BR2, BR4, BR6, BR8 can be fluidically coupled to the fourth primary manifold 64. Thus, the rows BR1–BR8 of drop generators can be alternatingly fluidically coupled, row by row, to the third primary manifold 63 and the fourth primary manifold 64.

The array B can thus be considered as a plurality of offset rows BR1–BR8 of ink drop generators, wherein each row of drop generators is fluidically coupled to a common primary manifold.

Each slanted columnar array BC1–BCN of drop generators can also be considered as being comprised of interleaved sub-columns, wherein one sub-column includes drop generators in the odd numbered rows BR1, BR3, BR5, BR7 while another sub-column includes drop generators in the even numbered rows BR2, BR4, BR6, BR8. In this manner, the ink drop generators of one sub-column are fluidically coupled to the associated third finger manifold 163 while the ink drop generators of the other sub-column are fluidically coupled to the associated fourth finger manifold 164. For the illustrative example wherein the third finger manifolds 163 provide yellow ink and wherein the fourth finger manifolds 164 provide black ink, each slanted column BC1–BCN is formed of a yellow (Y) sub-column interleaved with a black (K) sub-column.

By way of illustrative example, the array B can comprise a replica or copy of the array A that is contiguously adjacent the array A along the Y axis, such that each columnar array AC1–ACN of the array A has an associated columnar array BC1–BCN of the array B displaced therefrom along the Y axis. For ease of reference, a columnar array of the array A and its associated columnar array of the array B can be referred to as being vertically associated. Depending upon implementation, each A array columnar array can be aligned with the associated B array columnar array along the X-axis, such that each A array drop generator in a given array A columnar array is aligned along the X-axis with an associated drop generator in a vertically associated array B columnar array. In this manner, vertically associated ink drop generators (e.g., AC1/AR1 and BC1/BR1) are on a line that is substantially parallel to the Y-axis. Alternatively, each A array columnar array can be displaced or offset relative to the associated B array columnar array along the X-axis. For the illustrative example wherein the first through fourth finger manifolds 61–64 respectively provide magenta, cyan, yellow and black ink, each M drop generator can be associated with a Y drop generator, and each C drop generator can be associated with a K drop generator, as schematically depicted in FIG. 11.

The drop generator arrays A and B can be configured such that slanted columnar arrays BC1 through BCN-1 can be columnarly aligned with the slanted columnar arrays AC2 through ACN. In this manner, composite slanted columns AC2/BC1, AC3/BC2, etc. can formed. The drop generator arrays A and B can be relatively positioned so as to have uniform spacing between drop generators in each of the composite slanted columnar arrays AC2/BC1–ACN/BCN-1.

FIGS. 12–16 schematically illustrate embodiments of arrangements of the nozzles 47 of the printhead 20, as viewed from the nozzle side 131A of the printhead. Since the nozzles 47 are at the ends of the outlet channels 45 of the drop generators 30 of the arrays A, B, the nozzles 47 are arranged in nozzle arrays that can be conveniently called nozzle arrays NA, NB. The nozzle arrays NA, NB are generally side by side along the Y-axis such that the nozzle array NB is contiguously adjacent the nozzle array NA along the Y-axis.

The nozzles 47 of the drop generators are smaller than the ends of the outlet channels 35, and each nozzle can be selectively positioned within the end of the associated outlet channel. The ends of the outlet channels 35 can be circular or non-circular (e.g., oval or egg-shaped). Generally, the arrangement(s) of the nozzles 47 can be configured by selection of the slant of the columns of drop generators and selective positioning of the nozzles 47 in the end of their respective outlet channels 45.

The nozzles of the nozzle array NA are arranged in a linear array of slanted columnar arrays NAC1–NACN which generally correspond to the slanted columnar arrays AC1–ACN of the array A of drop generators. The linear array extends along the X-axis, and the slanted columnar arrays of nozzles can be mutually parallel and slanted or oblique relative to the X-axis as well as the Y-axis. Each columnar array of nozzles includes the same number of nozzles, and the columnar arrays of nozzles can be substantially aligned along the Y-axis such that the nozzles 47 form rows NAR1–NAR8 that can be mutually parallel and generally parallel to the X-axis. Eight rows are shown as an illustrative example and it should be appreciated that the number of rows can be appropriately selected. The nozzles of the nozzle array NA can be conveniently referenced by their columnar and row location (e.g., NAC1/NAR1 or NAC1/1, NAC1/NAR2 or NAC1/2, etc.).

By way of illustrative example, in each columnar array of nozzles, the ink drop generators of the odd numbered rows NAR1, NAR3, NAR5, NAR7 can be fluidically connected to an associated first finger manifold 161, while the nozzles of the even numbered rows AR2, AR4, AR6, AR8 can be connected to an associated second finger manifold 162 that is adjacent to the associated first finger manifold 161. In other words, the nozzles of each nozzle column NAC1–NACN are alternatingly fluidically coupled, row by row, to one of an associated pair of finger manifolds, wherein the associated pair of finger manifolds comprises a first finger manifold 161 and a second finger manifold 162 that is adjacent to the first finger manifold 161. In this manner, the nozzles of the odd numbered nozzle rows NAR1, NAR3, NAR5, NAR7 can be fluidically coupled to the first primary manifold 61, while nozzles of the even numbered nozzle rows NAR2, NAR4, NAR6, NAR8 can be fluidically coupled to the second primary manifold 62. Thus, the rows NAR1–NAR8 of nozzles can be alternatingly fluidically coupled, row by row, to the first primary manifold 61 and the second primary manifold 62.

Thus, each slanted columnar array NAC1–NACN of nozzles can comprise interleaved substantially parallel, linear odd row and even row sub-columns, wherein the odd row sub-column includes nozzles in the odd numbered rows NAR1, NAR3, NAR5, NAR7 while the even row sub-column includes nozzles in the even numbered rows NAR2, NAR4, NAR6, NAR8. For ease of reference, the nozzles in the odd numbered rows are labeled M, while the nozzles in the even numbered rows are labeled C, for the illustrative example wherein the first primary manifold 61 provides magenta ink and wherein the second primary manifold 62 provides cyan ink. For convenience, each odd row sub-column can be conveniently referred to as an M sub-column, and each even row sub-column can be conveniently referred to as a C sub-column. The interleaved substantially parallel M and C sub-columns of each columnar array NAC1–NACN can be non-colinear. In this manner, the nozzles of an M sub-column are fluidically coupled to an associated first finger manifold 161 (and the first primary manifold 61), while the nozzles of a C sub-column are fluidically coupled to an associated second finger manifold 162 (and the second primary manifold 62), for example. The spacing between nozzles in a sub-column and the angle of the sub-column relative to the Y-axis, for example, determine a nozzle pitch XP along the X-axis for the sub-column. The nozzle pitch XP can be substantially identical for both M and C sub-columns, for example. The angle of a sub-column relative to the Y-axis and the number of nozzles in the sub-column determine the span along the X-axis of the sub-column. By way of illustrative example, the angle of the M sub-columns and the number of nozzles in each M sub-column can be selected so that the nozzles of all the M sub-columns have a substantially uniform pitch XP along the X-axis. Similarly, the angle of the C sub-columns and the number of nozzles in each C sub-column can be selected so that the nozzles of all the C sub-columns have a substantially uniform pitch XP along the X-axis. By way of illustrative example, the M and C sub-columns include the same number of nozzles so that each M and C sub-column has substantially the same uniform pitch along the X-axis. Such substantially uniform nozzle pitch can be at most about $1/75$ inches, for example. As another example, the substantially uniform nozzle pitch XP of each of the M and C sub-columns can be at most about $1/37.5$ inches.

The interleaved M and C sub-columns, each having N nozzles, of a slanted columnar array of nozzles NAC1–NACN thus form N pairs of nozzles, wherein each pair includes a nozzle in the M sub-column (and thus in an odd numbered row) and a generally vertically adjacent nozzle in the C sub-column (and thus in an even numbered row), e.g., NAC1/1 and NAC1/2, NAC1/3 and NAC1/4, etc. Each sub-column includes a plurality of nozzles and thus N is greater than 1. Such nozzle pairs can be conveniently called odd/even nozzle pairs, and each pair can be conveniently referenced by columnar array and row locations, e.g., NAC1/1_2, NAC1/3_4, etc. For the illustrative example wherein the odd row nozzles provide magenta drops and the even row nozzles provide cyan drops, the odd/even nozzle pairs can be conveniently called MC nozzle pairs. The offset between each odd row sub-column and the even row sub-column with which it is interleaved can be selected such that the nozzles of each odd/even nozzle pair are aligned along the X-axis and thus parallel to the Y-axis (non-slanted) or offset along the X-axis and thus non-parallel to the Y-axis (slanted).

In this manner, the nozzles of the nozzle array NA can be viewed as being arranged in rows of odd/even nozzle pairs, wherein each odd/even nozzle pair comprises nozzles that are generally adjacent along the Y-axis.

The nozzles of the nozzle array NB are arranged in a linear array of slanted columnar arrays NBC1–NBCN which generally correspond to the slanted columnar arrays BC1–BCN of the array B of drop generators. The linear array extends along the X-axis, and the slanted columnar arrays of nozzles can be mutually parallel and slanted or oblique relative to the X-axis as well as the Y-axis. Each columnar array of nozzles includes the same number of nozzles, and the columnar arrays of nozzles can be substantially aligned along the Y-axis such that the nozzles 47 form rows NBR1–NBR8 that can be mutually parallel and generally parallel to the X-axis. Eight rows are shown as an illustrative example and it should be appreciated that the number of rows can be appropriately selected. The nozzles of the array NB can be conveniently referenced by their columnar and row location (e.g., NBC1/NBR1 or NBC1/1, NBC1/NBR2 or NBC1/2, etc.).

By way of illustrative example, in each columnar array of nozzles, the ink drop generators of the odd numbered rows NBR1, NBR3, NBR5, NBR7 can be fluidically connected to an associated third finger manifold 163, while the nozzles of the even numbered rows NBR2, NBR4, NBR6, NBR8 can be connected to an associated fourth finger manifold 164 that is adjacent to the associated third finger manifold 163. In other words, the nozzles of each nozzle column NBC1–NBCN are alternatingly fluidically coupled, row by row, to one of an associated pair of finger manifolds, wherein the associated pair of finger manifolds comprises a third finger manifold 163 and a fourth finger manifold 164 that is adjacent to the third finger manifold 163. In this manner, the nozzles of the odd numbered nozzle rows NBR1, NBR3, NBR5, NBR7 can be fluidically coupled to the third primary manifold 63, while nozzles of the even numbered nozzle rows NBR2, NBR4, NBR6, NBR8 can be fluidically coupled to the fourth primary manifold 64. Thus, the rows NBR1–NBR8 of nozzles can be alternatingly fluidically coupled, row by row, to the third primary manifold 63 and the fourth primary manifold 64.

Each slanted columnar array NBC1–NBCN of nozzles can comprise interleaved substantially parallel, linear odd row and even row sub-columns of nozzles, wherein the odd row sub-column includes nozzles in the odd numbered rows NBR1, NBR3, NBR5, NBR7 while the even row sub-column includes nozzles in the even numbered rows NBR2, NBR4, NBR6, NBR8. For ease of reference, the nozzles in the odd numbered rows are labeled Y, while the nozzles in the even numbered rows are labeled K, for the illustrative example wherein the third primary manifold 63 provides yellow ink and wherein the fourth primary manifold provides black ink. For convenience, each odd row sub-column can be conveniently referred to as a Y sub-column, and each even row sub-column can be conveniently referred to as a K sub-column. The interleaved substantially parallel sub-columns can be non-co-linear. In this manner, the nozzles of the Y sub-column (odd rows) are fluidically coupled to the associated third finger manifold 163 while the nozzles of the K sub-column (even rows) are fluidically coupled to the associated fourth finger manifold 164, for example. The spacing between nozzles in a sub-column and the angle of the sub-column relative to the Y-axis, for example, determine a nozzle pitch XP along the X-axis for the sub-column. The nozzle pitch XP can be substantially identical for the Y sub-column and the K sub-column, for example. The angle of a sub-column relative to the Y-axis and the number of nozzles in the sub-column determine the span along the X-axis of the sub-column. By way of illustrative example, the angle of the Y sub-columns and the number of nozzles in each Y sub-column can be selected so that the nozzles of all the Y sub-columns have a substantially uniform pitch XP along the X-axis. Similarly, the angle of the K sub-columns and the number of nozzles in each K sub-column can be selected so that the nozzles of all the K sub-columns have a substantially uniformly pitch along the X-axis. By way of illustrative example, the Y and K sub-columns include the same number of nozzles so that each sub-column has substantially the same uniform nozzle pitch along the X-axis. Such substantially uniform nozzle pitch can be at most about 1/75 inches, for example. As another example, the substantially uniform nozzle pitch XP of each of the Y and K sub-columns can be at most about 1/37.5 inches.

The interleaved Y and K sub-columns, each having N nozzles, of a slanted columnar array of nozzles NB1–NBN thus form N pairs of nozzles, wherein each pair includes a nozzle in the Y sub-column (and thus in an odd numbered row) and a generally vertically adjacent nozzle in the K sub-column (and thus in an even numbered row), e.g., NBC1/1 and NBC1/2, NBC1/3 and NBC1/4, etc. Such nozzle pairs can be conveniently called odd/even nozzle pairs, and each pair can be conveniently referenced by columnar array and row locations, e.g., NBC1/1_2, NBC1/3_4, etc. For the illustrative example wherein the odd row nozzles provide yellow drops and the even row nozzles provide black drops, the odd/even nozzle pairs can be conveniently called YK nozzle pairs. The offset between each odd row sub-column and the even row sub-column with which it is interleaved can be selected such that the nozzles of each odd/even nozzle pair are aligned along the X-axis and thus parallel to the Y-axis (non-slanted) or offset along the X-axis and thus non-parallel to the Y-axis (slanted).

In this manner, the nozzles of the nozzle array NB can be viewed as being arranged in rows of nozzle pairs, wherein each nozzle pair comprises nozzles that are generally adjacent along the Y-axis.

Each of the columnar arrays of the nozzle arrays NA, NB can have the same number of nozzles, the same number of columnar arrays NAC1–NACN, NBC1–NBCN, the same number of nozzles in each of the nozzle sub-columns, and the same number of odd/even nozzle pairs in each columnar array. The arrangement of nozzles in the array NA can be the same as the nozzle arrangement in the array NB, or it can be different, for example as described below.

The nozzle arrays NA, NB are contiguously adjacent along the Y-axis and can be relatively positioned along the X-axis such that each columnar array NAC1–NACN of the nozzle array NA has a respectively associated columnar array NBC1–NBCN of the nozzle array NA generally displaced therefrom along the Y-axis, and such that each odd/even nozzle pair NAC1/1_2–NACN/7_8 of the array NA has a respectively associated odd/even pair NBC1/1_2–NBCN/7_8 of the array NB. Associated columnar arrays NAC1/NBC1–NACN/NBCN can be aligned along the X-axis, or they can be offset along the X-axis, for example.

Figure 12:
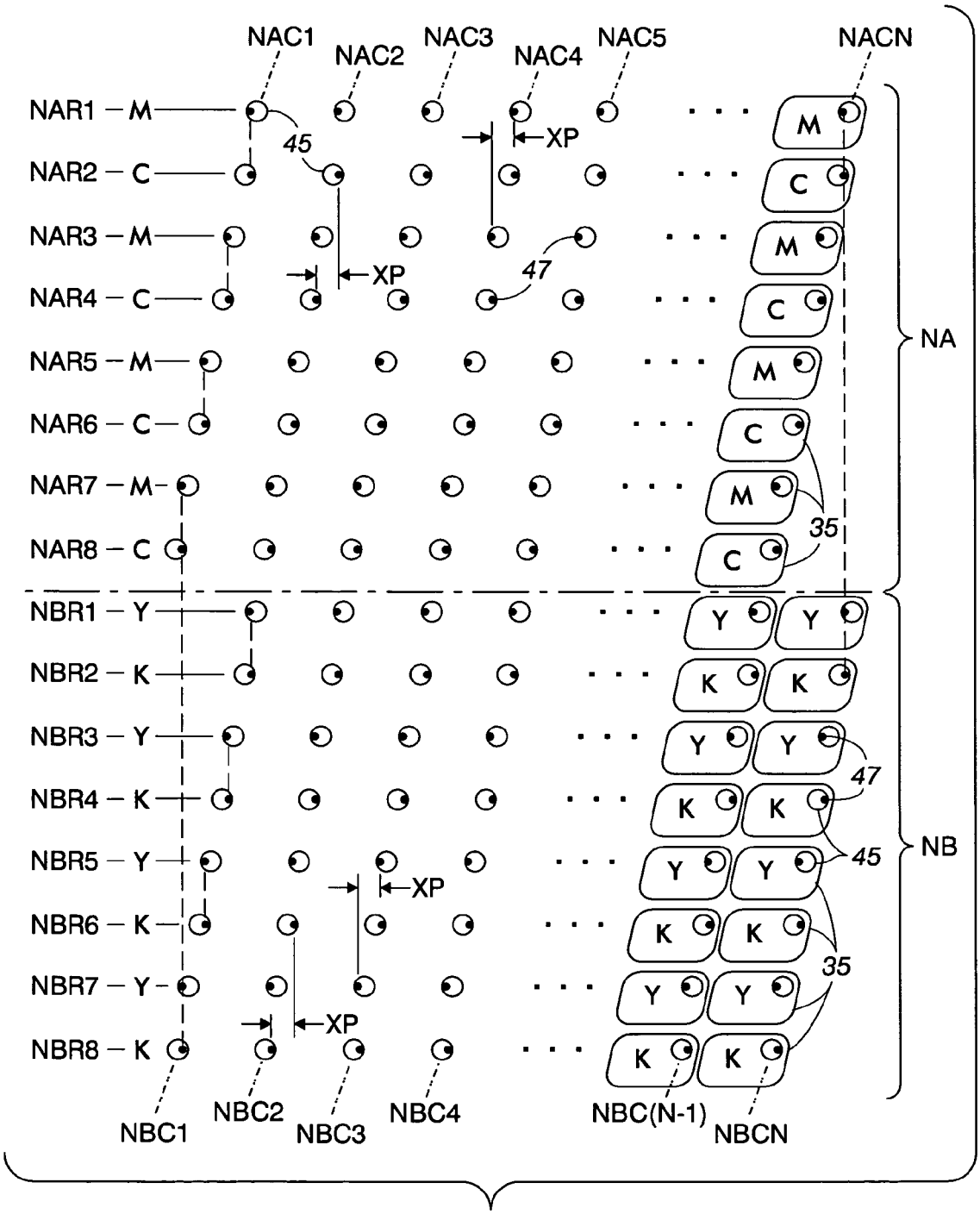
FIG. 12 schematically illustrates an arrangement of nozzles of the printhead of FIG. 3.
Figure 13:
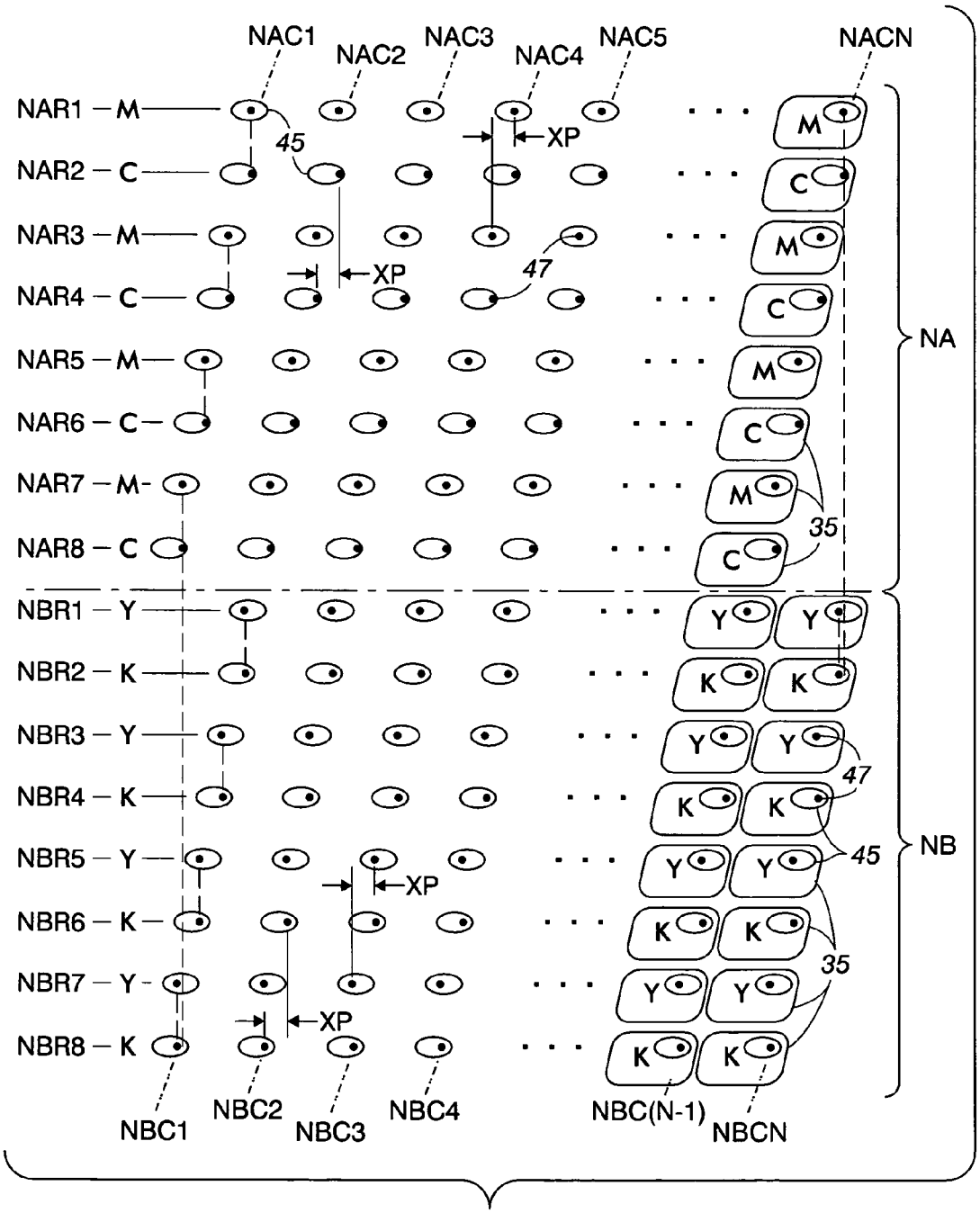
FIG. 13 schematically illustrates a further arrangement of nozzles of the printhead of FIG. 3.

By way of illustrative example, the nozzles of each odd/even nozzle pair in the columnar arrays of the nozzle arrays NA, NB can be aligned along the X-axis, as schematically illustrated for the array NA and the array NB in FIGS. 12 and 13. An odd/even nozzle pair having nozzles that are aligned along the X-axis can be conveniently called a non-offset or non-slanted nozzle pair. Each non-slanted nozzle pair in the nozzle array NB can be aligned along the X-axis with an associated non-slanted nozzle pair in the nozzle array NA, as schematically illustrated in FIG. 12. In another embodiment, each non-slanted nozzle pair in the nozzle array NB can be offset along the X-axis relative to an associated non-slanted nozzle pair in the nozzle array NA, as schematically illustrated in FIG. 13. The offset between associated non-slanted nozzle pairs can be greater than zero inches and at most about 0.005 inches, for example. As another example, the offset can be greater than zero inches and at most about 1/3 times the sub-column nozzle pitch XP along the X-axis (i.e., XP/3).

Figure 14:
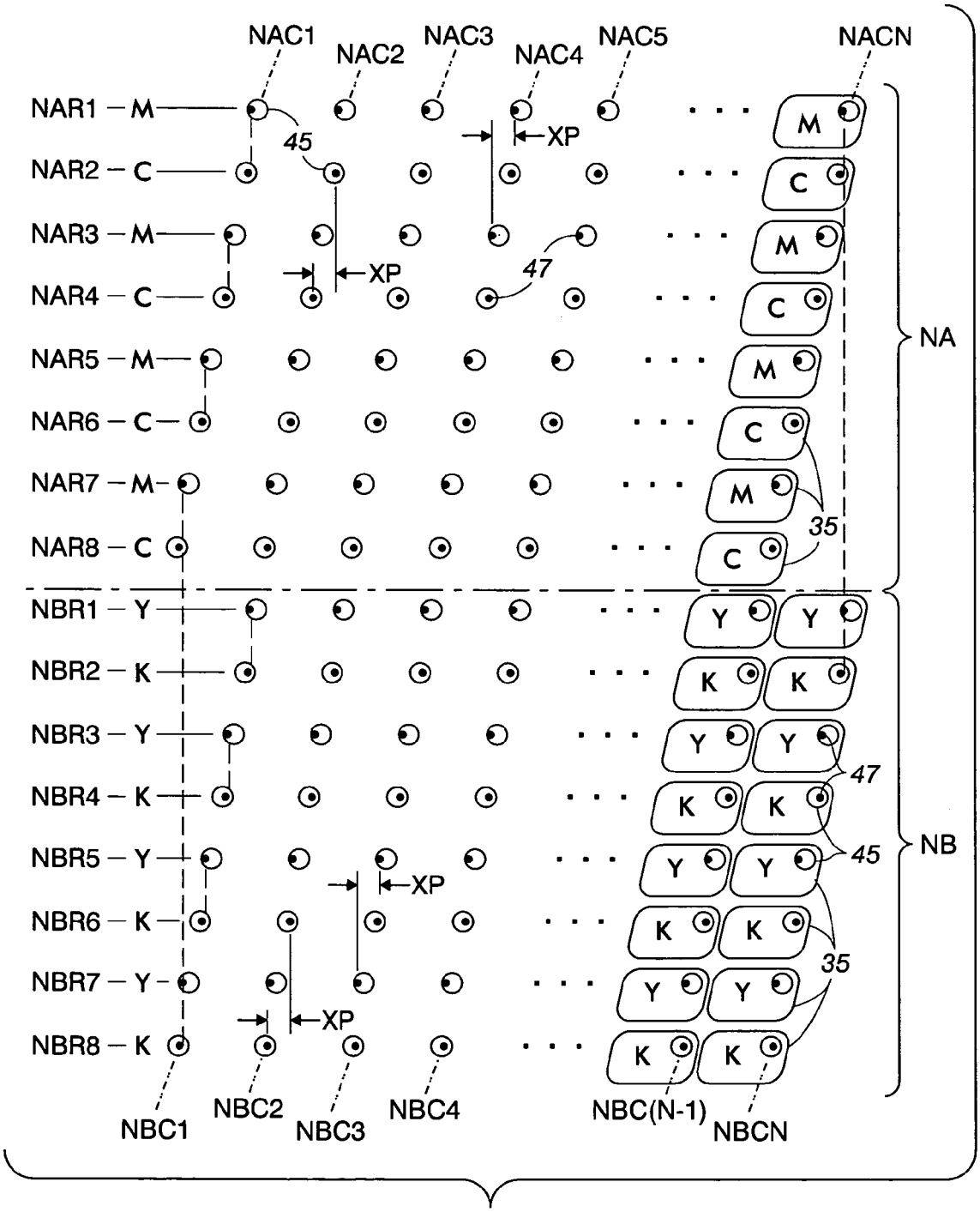
FIG. 14 schematically illustrates another arrangement of nozzles of the printhead of FIG. 3.
Figure 15:
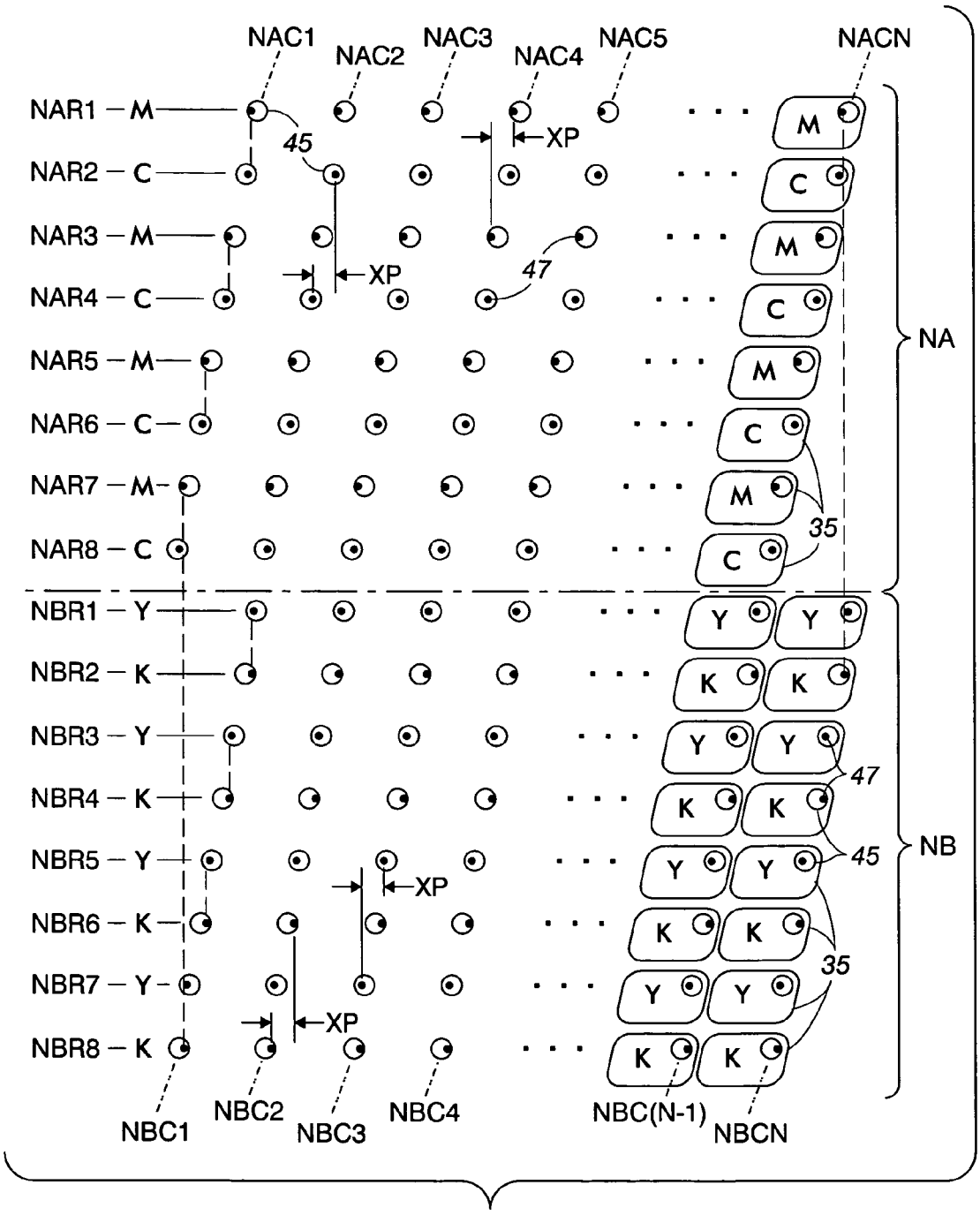
FIG. 15 schematically illustrates still another arrangement of nozzles of the printhead of FIG. 3.

By way of illustrative example, the nozzles of each odd/even nozzle pair in the columnar arrays of both of the nozzle arrays NA, NB can be offset along the X-axis, as schematically illustrated for the nozzle arrays NA and NB in FIGS. 14 and 15. An odd/even nozzle pair having nozzles that are offset along the X-axis can be conveniently called an offset or slanted nozzle pair. The offset along the X-axis between the nozzles of an offset or slanted nozzle pair can be greater than zero inches and no greater than about 0.005 inches, for example. As another example, the offset between the nozzles of a slanted nozzle pair can be at greater than zero inches and at most about 1/3 times the sub-column nozzle pitch XP along the X-axis (i.e. XP/3). Each slanted nozzle pair in the nozzle array NB can be aligned along the X-axis with an associated slanted nozzle pair in the nozzle array NA, as schematically illustrated in FIG. 14. In another embodiment, each slanted nozzle pair in the nozzle array NB can be offset along the X-axis relative to an associated slanted nozzle pair in the nozzle array NA, as schematically illustrated in FIG. 13. By way of specific example, the even row nozzles of associated slanted nozzle pairs (e.g., C and K) can be aligned along the X-axis so as to be parallel to the Y-axis. The odd row nozzles of associated slanted nozzle (e.g., M and Y) can be on either side of the even row nozzles along the X-axis. The offset along the X-axis between associated slanted nozzle pairs can be greater than zero inches and at most about 0.005 inches. As another example, such offset can be greater than zero and at most about 1/3 times the sub-column nozzle pitch XP along the X-axis.

Figure 16:
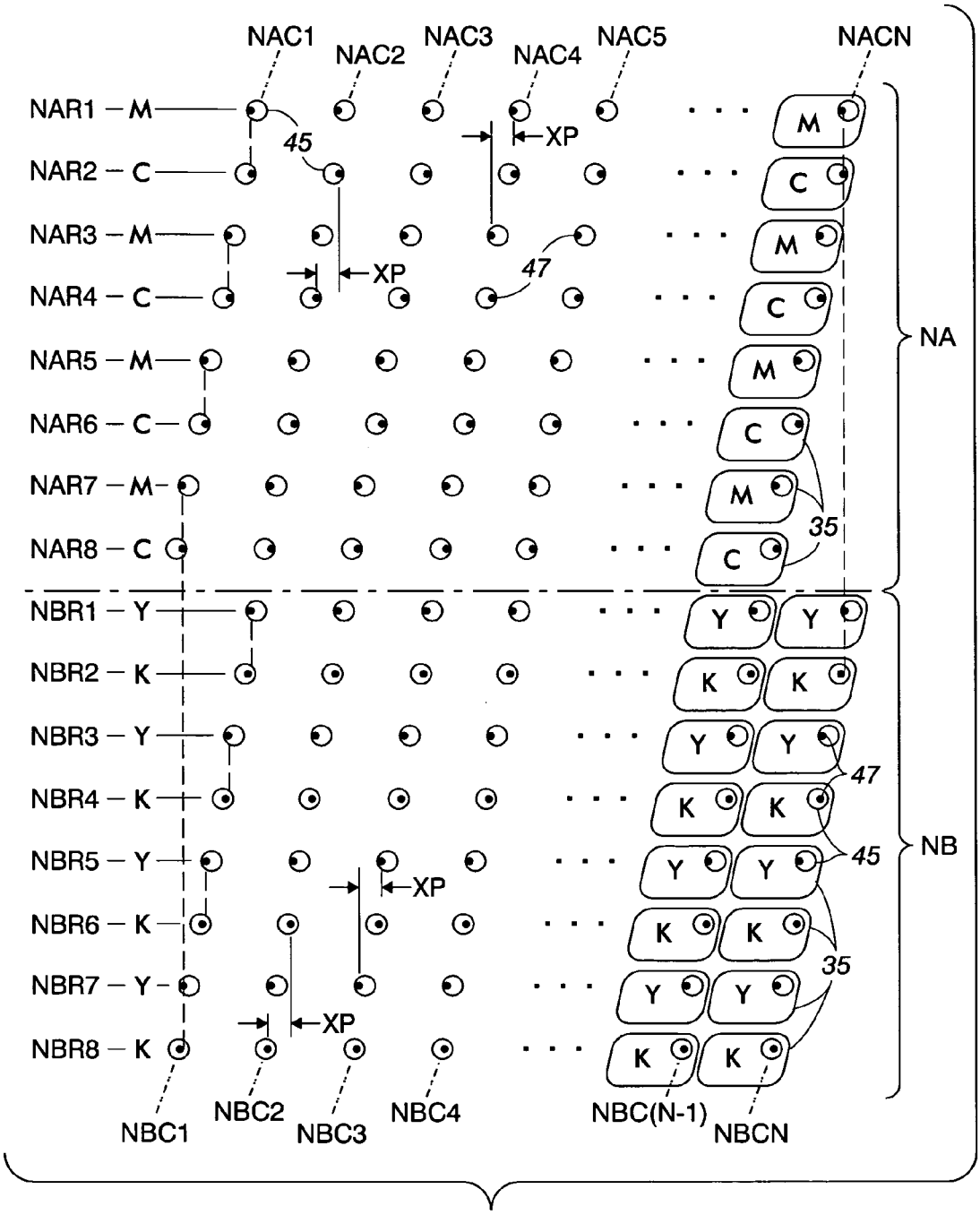
FIG. 16 schematically illustrates a further arrangement of nozzles of the printhead of FIG. 3.

By way of illustrative example, the odd/even nozzle pairs of the nozzle array NA can be non-slanted and the odd/even nozzle pairs of the nozzle array NB can be slanted, as schematically illustrated in FIG. 16. For example, one of a slanted nozzle pair of the nozzle array NB can be aligned along the X-axis with the associated non-slanted nozzle pair of the nozzle array NB. By way of specific example, each odd row nozzle of a slanted nozzle pair of the nozzle array NB (e.g., Y) can be aligned along the X-axis with the associated non-slanted nozzle pair of the nozzle array NA (e.g., M and C), such that the even row nozzle of such slanted nozzle pair (e.g., K) is offset along the X-axis relative to its associated odd row nozzle and the associated non-slanted nozzle pair of the nozzle array NA, for example as schematically depicted in FIG. 16. The amount of offset of the non-aligned nozzle can be greater than zero inches and at most about 0.005 inches, for example. As another example, the amount of offset of the non-aligned nozzle can be greater than zero inches and at most about ⅓ times the sub-column nozzle pitch XP along the X-axis.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting device comprising:

a first linear array of side by side substantially mutually parallel first columnar arrays of drop emitting nozzles, the first linear array extending along an X-axis, and the first columnar arrays being oblique to the X-axis;

each first columnar array of drop emitting nozzles comprised of a first linear sub-column of N nozzles that is interleaved with and substantially parallel to an associated second linear sub-column of N nozzles so as to form N first pairs of nozzles, wherein each first pair of nozzles includes a nozzle from the first linear sub-column and an adjacent nozzle from the second linear sub-column, and wherein N is greater than 1;

wherein the nozzles of each first pair of nozzles are offset along the X-axis;

wherein the first linear sub-columns of nozzles emit drops of a first color and the second linear sub-columns of nozzles emit drops of a second color;

a second linear array of side by side substantially mutually parallel second columnar arrays of drop emitting nozzles, the second linear array extending along the X-axis and being adjacent the first linear array along a Y-axis that is orthogonal to the X-axis, and the second columnar arrays being oblique to the X-axis;

each second columnar array having an associated first columnar array displaced thereform along the Y-axis;

each second columnar array of drop emitting nozzles comprised of a third linear sub-column of N nozzles that is interleaved with and substantially parallel to an associated fourth linear sub-column of N nozzles so as to form N second pairs of nozzles, wherein each second pair of nozzles includes a nozzle from the third linear sub-column and an adjacent nozzle from the fourth linear sub-column;

each second nozzle pair having an associated first nozzle pair displaced thereform along the Y-axis;

wherein the nozzles of each second pair of nozzles are offset along the X-axis;

wherein the third linear sub-columns of nozzles emit drops of a third color and the fourth linear sub-columns of nozzles emit drops of a fourth color; and wherein each of the first through fourth linear sub-columns has a nozzle pitch XP inches along the X-axis.

2. The drop emitting device of claim 1 wherein the first linear array of side by side substantially mutually parallel columnar arrays of drop emitting nozzles and the second linear array of side by side mutually parallel columnar arrays of drop emitting nozzles emit drops of melted solid ink.

3. The drop emitting device of claim 1 wherein each of the first through fourth sub-columns of nozzles has a nozzle pitch XP of at most about 1/75 inches along the X-axis.

4. The drop emitting device of claim 1 wherein each of the first through fourth sub-columns of nozzles has a nozzle pitch XP of at most about 1/37.5 inches along the X-axis.

5. The drop emitting device of claim 1 wherein each first pair of nozzles and its associated second pair of nozzles are aligned along the X-axis and substantially parallel to the Y-axis.

6. The drop emitting device of claim 1 wherein each first pair of nozzles and its associated second pair of nozzles are offset along the X-axis.

7. The drop emitting device of claim 1 wherein each first pair of nozzles and its associated second pair of nozzles are offset along the X-axis by at most about XP/3 inches.

8. The drop emitting device of claim 1 wherein each first pair of nozzles and its associated second pair of nozzles are offset along the X-axis by at most about 0.005 inches.

9. The drop emitting device of claim 1 wherein the nozzles of each first pair of nozzles are offset along the X-axis by at most about XP/3 inches.

10. The drop emitting device of claim 1 wherein the nozzles of each first pair of nozzles are offset along the X-axis by at most about 0.005 inches.

11. The drop emitting device of claim 1 wherein:

the nozzles of each first pair of nozzles are offset along the X-axis by at most about XP/3 inches; and the nozzles of each second pair of nozzles are offset along the X-axis by at most about XP/3 inches.

12. The drop emitting device of claim 1 wherein:

the nozzles of each first pair of nozzles are offset along the X-axis by at most about 0.005 inches; and the nozzles of each second pair of nozzles are offset along the X-axis by at most about 0.005 inches.

13. The drop emitting device of claim 1 wherein the first and second colors are magenta and cyan.

14. The drop emitting device of claim 1 wherein the third and fourth colors are yellow and black.

15. The drop emitting device of claim 1 wherein:

the first and second colors are magenta and cyan;

the third and fourth colors are yellow and black; and each second nozzle pair is offset relative to its associated first nozzle pair along the X-axis.

16. The drop emitting device of claim 1 wherein:

the first and second colors are magenta and cyan;

the third and fourth colors are yellow and black;

each second nozzle pair is offset relative to its associated first nozzle pair along the X-axis; and one of the nozzles of each second nozzle pair is aligned along the X-axis with one of the nozzles of its associated first nozzle pair.

17. The drop emitting device of claim 1 wherein:

the first and second colors are magenta and cyan such that the nozzles of each first nozzle pair respectively provide magenta and cyan;

the third and fourth colors are yellow and black such that the nozzles of each second nozzle pair respectively provide yellow and black;

each second nozzle pair is offset relative to its associated first nozzle pair along the X-axis; and the black nozzle of each second nozzle pair is aligned along the X-axis with the magenta nozzle of the associated first nozzle pair.

18. The drop emitting device of claim 1 further including:

a first plurality of finger manifolds fluidically coupled to the first linear sub-columns of nozzles;

a second plurality of finger manifolds fluidically coupled to the second linear sub-columns of nozzles;

a third plurality of finger manifolds fluidically coupled to the third linear sub-columns of nozzles; and a fourth plurality of finger manifolds fluidically coupled to the fourth linear sub-columns of nozzles.

19. A drop emitting device comprising:

a first linear array of columnar arrays of first nozzle pairs, the first linear array extending along an X-axis and the columnar arrays of first nozzles extending obliquely to the X-axis;

wherein the nozzles of each first nozzle pair are offset along the X-axis;

wherein one nozzle of each first nozzle pair emits drops of a first color and another nozzle of each first nozzle pair emits drops of a second color;

a second linear array of columnar arrays of second nozzle pairs, the second linear array extending along the X-axis and the columnar arrays of second nozzles extending obliquely to the X-axis;

wherein the nozzles of each second nozzle pair are offset along the X-axis;

wherein one nozzle of each second nozzle pair emits drops of a third color and another nozzle of each second nozzle pair emits drops of a fourth color;

wherein the first linear array and the second linear array extend along a X-axis, and wherein the second linear array is adjacent the first linear array such that each first nozzle pair has an associated second nozzle pair displaced therefrom along a Y-axis that is orthogonal to the X-axis.

* * * * *